United States Patent [19]

Fujinuma et al.

[11] Patent Number: 4,677,976

[45] Date of Patent: Jul. 7, 1987

[54] EMERGENCY MASK

[75] Inventors: Katsumi Fujinuma, 2-105; 1100-4, Ohaza-Iwatsuki, Iwatsuki City, Saitama Pref.; Tsuneyoshi Takase; Yoriyuki Hayashi, both of Shimonoseki, all of Japan

[73] Assignees: Toyo Cci Kabushiki Kaisha, Tokyo; Katsumi Fujinuma, Iwatsuki, both of Japan

[21] Appl. No.: 594,973

[22] Filed: Mar. 27, 1984

[30] Foreign Application Priority Data

Apr. 1, 1983 [JP] Japan ..... 58-46746[U]

[51] Int. Cl.[4] ..... A62B 7/00

[52] U.S. Cl. ..... 128/201.25; 128/206.15; 128/206.17

[58] Field of Search ..... 128/206.15, 206.17, 128/201.22, 201.23, 201.25, 201.28, 201.29, 206.16, 206.28, 201.26, 206.12, 205.28

[56] References Cited

U.S. PATENT DOCUMENTS

| | | | |
|---|---|---|---|
| 1,928,238 | 9/1933 | Willson et al. | 128/201.23 |
| 2,284,949 | 4/1940 | Cover | 128/206.15 |
| 2,893,387 | 4/1958 | Gongoll et al. | 128/206.15 |
| 3,072,119 | 5/1961 | Matheson | 128/206.17 |
| 3,161,491 | 12/1964 | Gongoll et al. | 128/206.17 |
| 3,621,841 | 11/1971 | Austin et al. | 128/201.25 |
| 4,231,359 | 11/1980 | Martin | 128/201.23 |
| 4,453,544 | 6/1984 | Silverthorn | 128/206.15 |

FOREIGN PATENT DOCUMENTS

| | | | |
|---|---|---|---|
| 316973 | 12/1920 | Fed. Rep. of Germany | 128/201.15 |
| 597685 | 5/1934 | Fed. Rep. of Germany | 128/201.25 |
| 1199620 | 8/1965 | Fed. Rep. of Germany | 128/201.25 |
| 510491 | 8/1939 | United Kingdom | 128/201.25 |

*Primary Examiner*—Henry J. Recla
*Attorney, Agent, or Firm*—Spencer & Frank

[57] ABSTRACT

The disclosed emergency mask comprises a hood, a face piece in the hood for respiration, and a canister-holder secured to the outer surface of the hood and communicating with the face piece. The canister-holder has an inlet opening to hold a canister containing antidote and check valves to prevent the user's expiration from entering the canister.

10 Claims, 7 Drawing Figures

EMERGENCY MASK

BACKGROUND OF THE INVENTION

1. Field of the Invention

This invention relates to an emergency mask, and more particularly to an emergency mask which detachably holds a canister containing air-purifying antidote, such as catalyzer and adsorbent, for removing noxious gas in the case of fire and other emergency.

2. Description of the Prior Art

Recently, emergency mask for use in case of fire and other emergency are required to remove not only white smoke and black smoke, but also noxious gases, such as carbon monoxide, hydrochloric acid, cyanic acid, chlorine, ammonia, benzene, aldehydes, nitrogen oxide, and the like. Various kinds of emergency masks have been proposed to cope with the noxious gas. For instance, emergency masks capable of detachably holding canisters loaded with antidote have been developed.

After having carried out various tests on the emergency masks proposed heretofore, the inventors have found out that the emergency masks of the prior art have a shortcoming in that the air-purifying ability of the antidote in the canister is rapidly deteriorated when the moist air expired from a person wearing the emergency mask (to be referred to as the "user's expiration", hereinafter) enters the canister.

SUMMARY OF THE INVENTION

The invention is based on the above finding of the inventors, and an object of the present invention is to obviate the above-mentioned shortcoming of the prior art by providing an improved emergency mask in which the user's expiration is utilized so as to close an intake check valve disposed in the passage of intake air through an air-purifying canister, whereby the user's expiration is prevented from entering the canister and the effectiveness of the antidote in the canister is maintained for a long period of time over the maximum life time thereof.

Another object of the invention is to provide an emergency mask having such a canister-holder which not only holds firmly an air-purifying canister in an airtight fashion without allowing any bypass of noxious gas therein, but also ensures its steady coupling with a respiratory member, such as a mouth piece or a nose cup (to be referred to as "face piece" hereinafter), of the mask.

A further object of the invention is to provide an emergency mask having a hood covering at least the face of a person wearing the emergency mask (to be referred to as "the user", hereinafter).

Another object of the invention is to provide an emergency mask set having a handy carrier bag which carries an emergency mask of the above-mentioned type packed in a dampproof envelope and wrapped by a flexible plastics sheet.

To fulfill the above objects, a preferred embodiment of the present invention uses a canister-holder having a canister chamber, or a first space, and an inside chamber, or a second space. The canister chamber of this embodiment is located below the inside chamber and communicates therewith through an inlet opening of the latter. The canister chamber is to hold detachably a canister carrying air-purifying antidote therein. The inside chamber has a tubular coupling end to be connected to a face piece, the above-referred inlet opening formed at a lower portion thereof, an intake check valve mounted on the inlet opening, an outlet opening formed at a suitable portion thereof, and an exhaust check valve mounted on the outlet opening.

The intake check valve is adapted to be closed by the user's expiration, so that the expiration containing a large amount of moisture is prevented from entering the canister so as to eliminate deterioration of the air-purifying ability of the antidote by the expiration. Thereby, the effectivity of the antidote in the canister is maintained for a long period of time.

The canister-holder is required to hold the canister steadily without allowing its accidental drop from the canister-holder and to prevent any noxious gases from bypassing into the inside chamber without passing through the canister. To this end, an embodiment of the invention uses a combination of a loop groove formed on the outer bottom surface of the inside chamber of the canister-holder around the inlet opening and a mating upward loop projection formed on the top end of the canister, so that the loop projection of the canister snugly fits in the loop groove around the inlet opening. A suitable packing may be inserted between the loop groove around the inlet opening and the loop projection of the canister.

Instead of the combination of the loop groove formed on the bottom of the canister-holder and the loop projection formed on the top of the canister, a combination of a downward loop rib formed on the bottom of the canister-holder around the inlet opening thereof and a flat top surface of the canister can be used. A packing may be inserted between the loop rib of the canister-holder and the flat top of the canister, in this case too.

A clamping member to urge the canister against the canister-holder around the inlet opening may be pivotally secured to the canister-holder, so as to further improve the airtight coupling between the canister-holder and the canister. Instead of such clamping member, mating screw threads may be formed at a suitable portion of the canister-holder around the inlet opening and a top portion of the canister, so that the canister is tightly coupled to the canister-holder.

A typical canister containing air-purifying antidote has an intake hole at the bottom thereof and a discharge hole at the top thereof, and the canister preferably has a rectangular cross section at right angles to its height between the bottom with the intake hole and the top with the discharge hole. The length (b) of the rectangular cross section of the canister is preferably longer than about 1.15 time, more preferably 1.2 time, of its width (a), and the height (c) of the canister is preferably the same as or larger than the width (a) of its rectangular cross section.

The canister with the rectangular cross section may be held by the canister-holder with a spacing from the hood of the emergency mask in a horizontally forward direction relative to the face piece, while making the forward spacing larger than lateral offset of the canister relative to the horizontally forward direction. With the canister held in such a way, the user of the emergency mask can have a broad field of view, and the canister itself can be made thin because the thickness of the canister is represented by the above-mentioned width (a). Thus, such emergency mask of the invention can be folded into a thinner form than conventional emergency masks, so that emergency mask of the invention is easy to carry because it can be put into a brief case, an attache case, a hand bag, or the like, which is too small to hold any conventional emergency mask.

The emergency mask of the invention can be packed in a small rectangular carrier bag, and such rectangular carrier bag can be placed in a suit case or a storage shelf without necessitating any dead space therearound, especially as compared with conventional masks requiring large round carrier bags. Thus, the emergency mask of the invention is economical in storage space and handy in handling.

The hood of the emergency mask according to the invention preferably covers the entire face and head of the user. Further, the hood may have a skirt portion which protects the shoulder of the user. In the case of fire, such emergency mask not only protects the user from smokes and noxious gases by the antidote of the canister, but also protects the head and the shoulder of the user from the heat of fire by the hood.

The hood of the emergency mask having the canister-holder and the face piece secured thereto is made of non-inflammable synthesized leather, woven or non-woven cloth coated with aluminum. The hood covers the head and possibly shoulder of the user. A comparatively large transparent window is provided on the hood, so that the user can see the surroundings. The transparent window is made of transparent material which withstands against hot wind, such as non-flammable soft vinyl film, and the like.

In a preferred embodiment of the invention, a cylindrical sealing member made of soft non-flammable plastics film or the like is secured to an air passage hole of the hood. More particularly, one end of such cylindrical sealing member is continuously secured to the periphery of the air passage hole of the hood by welding or by adhesive, so that the opposite end of the sealing member extends into the inside of the hood. Preferably, the coupling end of the canister-holder is dimensioned so as to fit into the inside of the cylindrical sealing member from the outside of the hood. The coupling end of the face piece made of non-flammable soft resilient material, such as synthetic rubber, plastics, and the like, is preferably fitted onto the inner end of the cylindrical sealing member from the inside of the hood. Whereby, the canister-holder is tightly connected to the face piece through the cylindrical sealing member with one end thereof continuously secured to the hood, and the air-tightness of the connection therebetween is greatly improved.

In another embodiment of the emergency mask of the invention, a sleeve-like neck cover is provided in its hood covering the user's head. The neck cover is made of non-flammable non-breathable soft material, such as non-flammable plastics sheet, and has one end thereof continuously secured to the inner peripheral surface of the hood at a position corresponding to the chin or neck of the user. The opposite end of the neck cover is made contractible with elastic cords, such as rubber strings, attached thereto. To put on the hood of the emergency mask, the user at first spread the contractible end of the neck cover and then puts on the hood on his head. When the user wears the neck cover in the above-mentioned manner, the contractible end of the neck cover comes in tight contact with his neck, whereby the outside smoke and noxious gas are pevented from coming to the face of the user without failure so as to ensure protection of the face and neck of the user against such outside smoke and noxious gas.

To increase the resistance against inadvertent drop of the canister away from the canister-holder, a suitable resistive means may be provided. For instance, certain undulation may be formed on that surface of the canister-holder which is to contact the canister, while forming mating undulation on the canister surface to be in contact with the canister-holder. To prevent accidental dismount of the hood from the user's head, suitable band loops and buckles may be provided on the hood and the canister-holder, so as to fasten the hood and the canister-holder to the user's head by a suitable fastening band or a rubber fastener.

It is noted that, for any emergency mask, a container of the mask is important as the emergency mask itself. Japanese Industrial Standard (JIS) Z0301 provides for standard methods of storing emergency smoke masks and the like protectors for fire emergency. For instance, those which are susceptible to deterioration by exposure to water vapor, carbon dioxide gas, and ultraviolet rays, are to be wrapped by dampproof material such as aluminum foil with a thickness of not smaller than 0.025 mm as stipulated in Table 1 of JIS Z1520 or equivalent thereof.

The fact that the above JIS standards refer to aluminum foils indicates that the aluminum foil has an outstandingly high dampproofness, but the aluminum foil is liable to generation of pinholes and other defects. Accordingly, to maintain a high dampproofness for a long period of time, the aluminum foil must be handled very carefully. Some of the conventional emergency smoke masks are packed in envelopes made of aluminum foil lined with paper, plastic film or cellophane (to referred to as "the aluminum foil with lining", hereinafter) and placed in carrier bags made of cloth. However, even the last mentioned envelopes made of the aluminum foil with lining for packing the masks are liable to generation of pinholes depending on the manner in which the carrier cloth bag is handled.

The inventors have carried out a number of tests on the dampproof waterproof packing envelope of the emergency mask, such as envelopes made of dampproof membrane like aluminum vapor-deposited membrane and the aluminium foil with lining, with particular emphasis on the protection of the dampproof membrane. As a result, the inventors found that the simplest way of packing the emergency mask is to pack the emergency mask in an envelope made of dampproof membrane, seal the envelope, and simply wrap the sealed envelope with a flexible sheet such as a plastics sheet. Such wrapping not only simplifies the placing of the wrapped one in a carrier bag made of cloth or the like while preventing generation of defects such as pinholes, but also produces snug fitting of the emergency mask in a carrier bag so as to make it appear attractive. The placing of the plastics or other flexible sheet in the carrier bag together with the dampproof membrane envelope is useful in preventing generation of pinholes and other defects of the dampproof membrane during the handling of the carrier bag.

For ready use, the emergency mask is usually stored after packing it in a dampproof membrane envelope with the canister mounted on the canister-holder and with both the bottom intake hole and the top discharge hole of the canister kept open. However, it is also possible to store the canister with both its bottom intake hole and its top discharge hole kept closed, so that the two holes of the canister are opened just before mounting in on the canister-holder.

BRIEF DESCRIPTION OF THE DRAWINGS

For a better understanding of the invention, reference is made to the accompanying drawings, in which.

Through different views of the drawings, 1 is an emergency mask, 3 is a canister, 5 is a canister-holder, 7 is a face piece, 8 is a coupling end of the face piece, 11 is a first space or a canister chamber, 13 is a free opening, 15 is an inlet opening, 17 is a sidewall, 19, 19' are intake check valves, 21 is a second space or an inside chamber, 23 is a coupling end of the canister-holder, 25, 25' are outlet openings, 27 is a cover, 29 is a heat-radiating hole, 31 is a third space, 33, 37 are exhaust check valves, 35 is a small hole, 39 is a protector, 41 is a clamping member, 43 is a packing, 45 is a loop rib, 46 is a loop groove, 47 is a hood, 49 is a fastening band, 51 is a can, 53 is a loop projection, 55 is top of the can, 57 is a discharge hole, 58 is an intake hole, 59 is an air passage hole of the hood, 61 is a transparent window, 63 is a neck cover, 65 is an upper end of the neck cover, 67 is a lower end of the neck cover, 69 is an elastic cord, 71 is a sealing member, 75 is a dampproof membrane envelope, 77 is a sealed portion, 79 is a plastic sheet, 81 is a carrier bag, 83 is a lid, 85 is a handle, A is the direction of air being inspired, and B is the direction of air being expired.

DESCRIPTION OF THE PREFERRED EMBODIMENTS

Referring to FIG. 1 through FIG. 4, an emergency mask 1 according to the present invention comprises essentially a canister 3 carrying air-purifying antidote therein, a canister-holder 5 detachably holding the canister 3, and a face piece 7 coupled to the canister-holder and adapted to come in contact with the nose and/or mouth of a wearer or user of the mask 1. The face piece 7 is for instance a nose cup or a mouth piece, and it is preferably made of a suitable resilient material.

Figure 1:
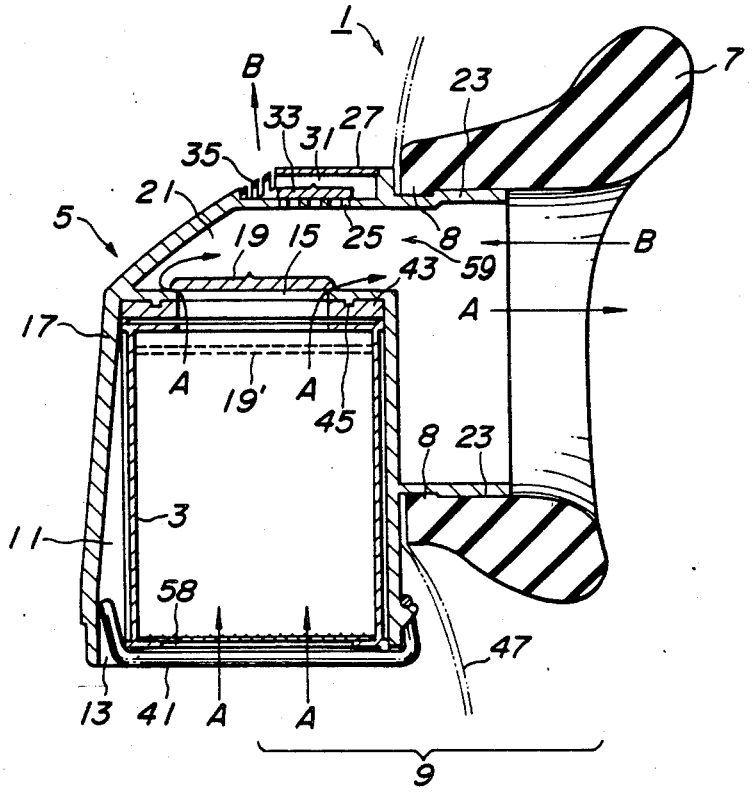
FIG. 1 is a schematic sectional view of the essential portion of an emergency mask according to the present invention, illustrating the relationship among a canister, a canister-holder, and a face piece.

The canister-holder 5 of the embodiment of FIG. 1 has a first space or a canister chamber 11 and a second space or an inside chamber 21. The first space 11 has a free opening 13 bored at the bottom portion thereof, and sidewalls 17 surrounding the periphery thereof. The top of the first space 11 communicates with the inside chamber 21 through an inlet opening 15 thereof.

The canister 3 contains air-purifying antidote loaded therein depending on the purpose and the use thereof, and it is detachably mounted in the first space 11 with a packing 43 inserted between the periphery of the inlet opening 15 and the top of the canister 3. The packing 43 has a through hole aligned with the inlet opening 15, with which the top discharge hole 57 (FIG. 3) of the canister 3 must be aligned. A clamping member 41 urges the canister 3 against the periphery of the inlet opening 15, so as to form an airtight contact therebetween. The embodiment of FIG. 1 has a loop rib 45 extending downward from the lower surface of the peripheral wall of the inlet opening 15, so as to improve the airtight contact between the above peripheral wall and the top of the canister 3.

The inside chamber 21 is located above the first space 11 and communicates therewith through the inlet opening 15. In the embodiment of FIG. 1, an intake check valve 19 is mounted on the inlet opening 15 in such a manner that its valve body moves upward against gravity when the valve 19 opens. The intake check valve can be mounted within the canister 3 as shown by the dotted line 19' of FIG. 1, instead of the position of the solid line 19 on the inlet opening 15. The inside chamber 21 extends horizontally and has a coupling end 23 at the end to be connected to the face piece 7. More particularly, the coupling end 23 is airtightly connected to the periphery of an air passage hole 59 of a hood 47, and the face piece 7 has its own coupling end 8 airtightly joined to the coupling end 23 of the inside chamber 21, so as to form an air passage from the inlet opening 15 to the face piece 7.

Figure 2:
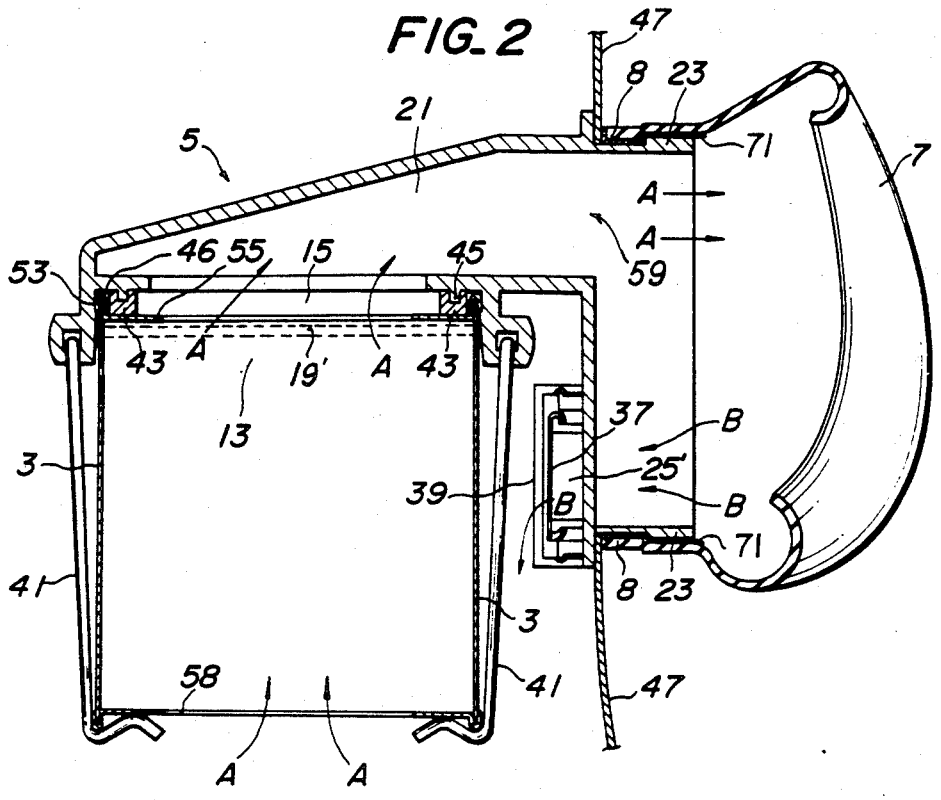
FIG. 2 is a schematic sectional view similar to FIG. 1, showing the relationship among a canister, a canister-holder, and a face piece in another embodiment of the invention.

An outlet opening 25 is bored on the top wall of the inside chamber 21 in the embodiment of FIG. 1, while a similar outlet opening 25' is bored on the sidewall of the inside chamber 21 in the embodiment FIG. 2. In FIG. 1, a lid 27 is detachably secured to the outside of the inside chamber 21 for instance by a snap hook means, so as to extend above the outlet opening 25 and define a third space 31 therebetween. An exhaust check valve 33 is mounted on the outlet opening 25 in such a manner that its valve body moves upward against gravity when the valve 33 opens. A plurality of small holes 35 are bored through the lid 27 at a position away from the face piece 7, so as to communicate the thrid space 31 with the outside atmosphere.

Figure 4:
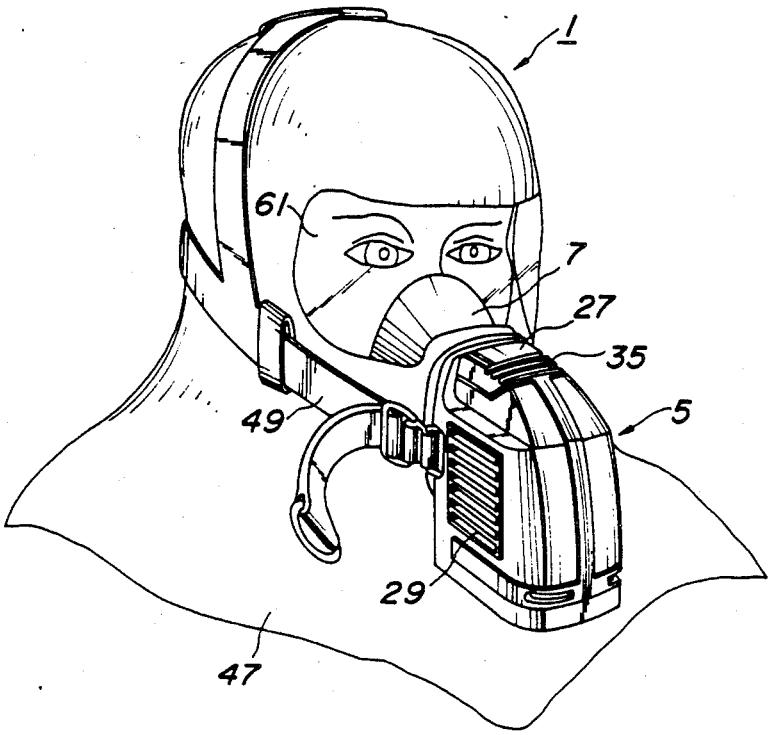
FIG. 4 is a schematic perspective view of an emergency mask of the invention, which is put on the head of a user.

The embodiment of FIG. 4 has a large number of heat-radiating holes 29 bored through the sidewall of the canister-holder 5, so as to dissipate the heat generated in the canister 3. The shape and the number of the heat-radiating holes 29 depends on the expected conditions under which the emergency mask is used.

In operation of the embodiment of FIG. 1, the air to be inspired (to be referred to as "inspiration", hereinafter) by the user enters into the canister 3 through the free opening 13 of the first space 11 and the bottom intake hole 58. The inspiring action of the user causes a suction in the inside chamber 21, so that the valve body of the intake check valve 19 is raised by the suction to open the intake check valve 19, while the suction coacts with the gravity in pulling down the valve body of the exhaust check valve 33 so as to close the exhaust check valve 33. Accordingly, after passing the intake hole 58, the inspiration flows through the antidote loaded in the canister 3, the inlet opening 15, the then open intake check valve 19, the inside space 21, the coupling end 23 of the inside space 21, and the face piece 7, so as to reach the respiratory face organ, i.e. nose and/or mouth, of the user, as indicated by the arrows A of the figure.

Thus, if the outside air contains any noxious gas, the outside air can reach the user only through the canister 3 because the exhaust check valve 33 is closed when he inspires, as described above, so that the antidote in the canister 3 purifies the air by removing the noxious gas, so as to provide clean safe air to the user. The flow of inspiration is also shown by the arrows A in the embodiment of FIG. 2.

The air expired (to be referred to as "expiration", hereinafter) by the user produces a rise of the pressure in the inside chamber 21. The raised pressure acts to push up the valve body of the exhaust check valve 33 so as to open the exhaust check valve 33, while the same raised pressure coacts with the gravity in pushing down the valve body of the intake check valve 19 so as to close the intake check valve 19. Thus, the expiration from the user flows to the outside atmosphere through the face piece 7, the coupling end 23, the inside chamber 21, the then open exhaust valve 33, and the small holes 35, as shown by the arrows B of FIG. 1. It is very important in the present invention that the expiration containing a large amount of moisture is prevented from entering the canister 3 by the intake check valve 19 or 19', so that the risk of deterioration of the antidote in the canister 3 by the expiration is completely eliminated in the emergency mask 1 of the present invention.

In the embodiment of FIG. 2, the outlet opening 25' is provided with an exhaust check valve 37 which is mechanically protected by protectors 39 such as rods and screens. The flow of the expiration in the embodiment of FIG. 2 is also shown by the arrows B, and such flow of the expiration never enters the canister 3.

In the embodiment of FIG. 1, the loop rib 45 coacts with the packing 43 in forming an airtight sealing of the joint between the canister-holder 5 and the canister 3. The clamp member 41 assists such airtight sealing by urging the canister 3 upwards against the loop rib 45. The clamp member 41 may be replaced with a screw thread coupling means or the like coupling means (not shown) between the canister 3 and the canister-holder 5.

Figure 3:
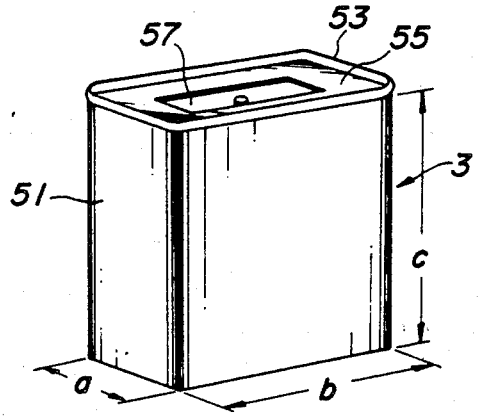
FIG. 3 is a schematic perspective view of a preferred embodiment of the canister to be used in the emergency mask of the invention.

The face piece 7 of the embodiment of FIG. 2 is a nose cup which has an inner end folded back inwardly so as to provide a soft contact of the nose cup with the nose and mouth of the user. The canister-holder 5, which is connected to the nose cup 7, has a loop groove 46 formed on the lower bottom surface of the inside chamber 21 around the inlet opening 15. The loop groove 46 is adapted to receive a loop projection 53 formed on a can 51 of the canister 3. A packing 43 is inserted between the bottom wall of the canister-holder 5 around the inlet opening 15 and the top 55 of the can 51 of the canister 3, so that an airtight junction is formed therebetween, and the outside air or noxious gas is prevented from entering the inside chamber 21 through this junction. The clamping means 41 of this embodiment also assists the formation of the airtight junction between the canister-holder 5 and the canister 3, and such clamping means 41 may be replaced with a suitable screw thread coupling means (not shown). FIG. 3 shows a discharge hole 57 bored on the top 55 of the can 51 of the canister 3.

The emergency mask 1 of the invention uses a hood 47, as shown by the dash-dot lines of FIG. 1 and the solid lines of FIG. 2 and FIG. 4. The hood 47 has an air passage hole 59, and the periphery of the air passage hole 59 is sandwiched by the coupling end 23 of the canister-holder 5 in the outside of the hood 47 and the coupling end 8 of the face piece 7 in the hood 47, so that the hood 47 is airtightly joined to both the canister-holder 5 and the face piece 7 in an integral fashion. The hood 47 may be secured to the head of the user by a fastening band 49, as shown in FIG. 4.

Figure 5:
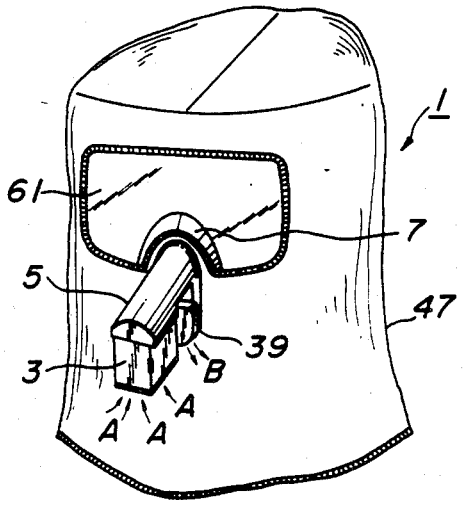
FIG. 5 is a schematic perspective view of another embodiment of the emergency mask according to the present invention.

The hood 47 of FIG. 5 covers the entire head of the user, and the hood 47 of FIG. 4 covers both the head and the shoulder of the user. The hood 47 is made of non-flammable flexible sheet material, such as non-flammable synthetic leather or plastics sheet, or woven or non-woven cloth coated with aluminum. The illustrated hood 47 has a fairly large transparent window 61 which provides a broad field of view, so that the user can see the surroundings even after wearing the emergency mask 1. The transparent window 61 may be made of a non-flammable transparent sheet material, such as non-flammable vinyl film which withstands against hot wind. The transparent window 61 may be coated with a thin heat-resistant metallic film evaporated thereon.

Figure 6:
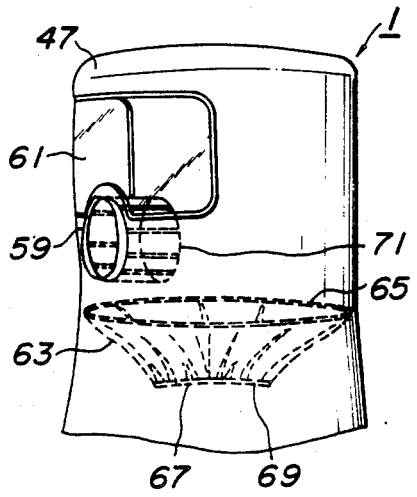
FIG. 6 is a schematic perspective view of a further embodiment of the emergency mask of the invention, showing the inside of its hood in phantom lines.

FIG. 6 illustrates the structure of the hood 47, especially the inside structure thereof. The sleeve-like neck cover 63 made of non-flammable non-breathable flexible plastics is disposed in the hood 47. The neck cover 63 has its upper end 65 continuously secured to the inner periphery of the hood 47 at a position corresponding to the chin or neck of the user and the lower end 67 made contractible. The lower edge of the neck cover 63 is folded back so as to form a channel in which an elastic cord 69 such as a rubber string is inserted, so that the lower end 67 thereof becomes resiliently contractible. When the user puts on the hood of FIG. 6 on his head, the lower end 67 of the neck cover 63 comes in tight contact with his neck, and the outside fume or noxious gas is prevented from reaching his face without failure.

A substantially cylindrical sealing member 71 made of non-flammable plastics film or the like extends from the periphery of the air passage hole 59 of the hood 47 to the inside thereof. More particularly, the outer end of the sealing member 71 is continuously secured to the periphery of the air passage hole 59 of the hole 47 by welding or adhesive. The airtightness of the junction between the canister-holder 5 and the face piece 7 can be greatly improved by inserting the thus formed sealing member 71 therebetween as shown in FIG. 2.

The emergency mask 1 of the present invention can use the canister 3 of the prior art. Preferably, the canister 3 contains a desiccant, a filter, and Hopkalite catalyzer (consistng of major active components of copper oxide (15–30% by weight) and manganese dioxide and optional active component of silver oxide and/or cobalt oxide), which are disposed in said order from the intake hole 58 of the can 51.

Figure 7:
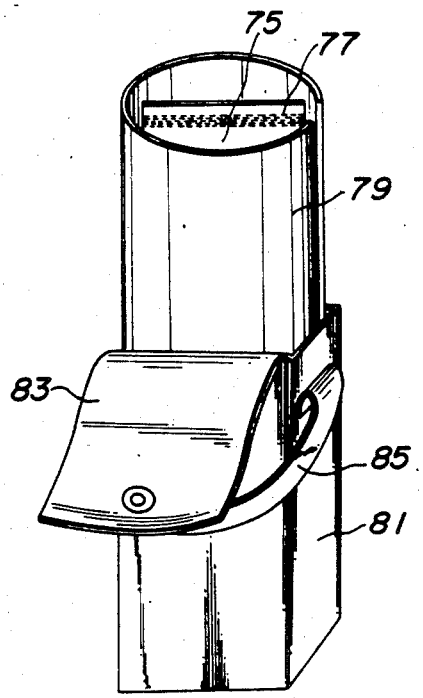
FIG. 7 is a schematic perspective view of a carrier bag for the emergency mask according to the present invention.

FIG. 7 shows a carrier bag 81 suitable for storing and carrying the emergency mask 1 of the present invention. For protection against water and moisture, the emergency mask 1 is packed in a dampproof envelope 75 made of dampproof membranes, such as the aluminum foils with lining and membranes with aluminum vapor-deposited thereon. The dampproof envelope 75 is sealed at a portion 77, and the thus sealed envelope 75 is wrapped by a flexible sheet 79 such as a flexible plastics sheet. The sheet emergency mask 1 in the dampproof envelope 75 is placed in a carrier bag 81 together with the flexible sheet material 79. The carrier bag 81 is for instance made of cloth and has a lid 83 and a handle 85, so as to facilitate the easy carrying of the emergency mask 1 while ensuring careful protection thereof.

Although the invention has been described with a certain degree of particularity, it is understood that the present disclosure has been made only by way of example, and that numerous changes in details of construction and the combination and arrangement of parts may be resorted to without departing from the scope of the invention as hereinafter claimed.

What is claimed is:

1. An emergency mask comprising: a hood covering at least the face of a user and having an air passage hole; a face piece attached to the inside of the hood so as to engage the nose and mouth of the user and having a tubular coupling end; a canister containing air-purifying antidote therein and having two opposed ends, with an intake hole being disposed at one end and a discharge hole being disposed at the other end, an inlet check valve; and an outlet check valve; characterized in that the mask further comprises: a substantially cylindrical sealing member made of soft non-flammable flexible material and having one end thereof airtightly secured to the periphery of the air passage hole of said hood; a canister-holder having a tubular coupling end thereof airtightly coupled with said tubular coupling end of the face piece, with said sealing member being interposed between said tubular coupling end of said canister-holder and said tubular coupling end of said face piece so as to create an airtight seal between said hood, said face piece and said canister-holder; said canister-holder having an inside chamber defined therein which chamber communicates with said face piece through said coupling end thereof and has an inlet opening and an outlet opening; and a connecting means for airtightly connecting said canister to said canister-holder in a detachable manner with the discharge hole of the canister facing the inlet opening of the canister-holder, the connecting means having a loop rib projecting toward said canister around the inlet opening of the canister-holder, and a clamp means pivotally secured to said canister-holder so as to selectively engage and urge the canister toward said loop rib for causing airtight coupling between the other end of the canister and the canister-holder around said inlet opening; the inlet check valve being interposed between the intake hole of the canister and the inside chamber of the canister-holder for permitting air flow through the inlet opening of the inside chamber only in the direction from the canister toward the inside chamber; and the outlet check valve being mounted on said outlet opening of said canister-holder so as to allow air outflow through said outlet opening only away from the inside chamber and exclusively to the atmosphere.

2. An emergency mask as set forth in claim 1, wherein said face piece is a nose cup adapted to come in contact with the nose of a user.

3. An emergency mask as set forth in claim 1, wherein said inlet check valve is mounted in the canister so as to allow air flow therethrough only toward said discharge opening thereof.

4. An emergency mask as set forth in claim 1, wherein said connecting means further comprises a packing inserted between the loop rib of the canister-holder and the other end of the canister.

5. An emergency mask as set forth in claim 1, further comprising a substantially cylindrical neck cover made of non-flammable and non-breathable flexible material and having a circular edge at one end thereof secured continuously to the inner periphery of said hood at a position below said face piece, said neck cover having an end which is opposite said one end and which is contractible.

6. An emergency mask comprising: a hood covering at least the face of a user and having an air passage hole; a face piece attached to the inside of the hood so as to engage the nose and mouth of the user and having a tubular coupling end; a canister containing air-purifying antidote therein and having two opposed ends, with an intake hole being disposed at one end and a discharge hole being disposed at the other end; an inlet check valve; and an outlet check valve; characterized in that the mask further comprises: a substantially cylindrical sealing member made of soft non-flammable flexible material and having one end thereof airtightly secured to the periphery of the air passage hole of said hood; a canister-holder having a tubular couplig end thereof airtightly coupled with said tubular coupling end of the face piece, with said sealing member being interposed between said tubular coupling end of said canister-holder and said tubular coupling end of said face piece so as to create an airtight seal between said hood, said face piece and said canister-holder; said canister-holder having an inside chamber defined therein which chamber communicates with said face piece through said coupling end thereof and has an inlet opening and an outlet opening; and a connecting means for airtightly connecting said canister to said canister-holder in a detachable manner with the discharge hole of the canister facing the inlet opening of the canister-holder, said connecting means having a loop groove formed around the inlet opening of the canister-holder so as to face toward said canister, a loop projection formed on a top portion of the canister so as to snugly fit in said loop groove of the canister-holder, and a clamp means pivotally secured to said caister-holder so as to selectively engage and urge the canister toward said loop groove for causing airtight coupling between the other end of the canister and the canister-holder around said inlet opening; the inlet check valve being interposed between the intake hole of the canister and the inside chamber of the canister-holder for permitting air flow through the inlet opening of the inside chamber only in the direction from the canister toward the inside chamber; and the outlet check valve being mounted on said outlet opening of said canister-holder so as to allow air outflow through said outlet opening only away from the inside chamber and exclusively to the atmosphere.

7. An emergency mask as set forth in claim 6, wherein said connecting means further comprises a packing inserted between the canister-holder around said inlet opening and the other end of said canister.

8. An emergency mask comprising: a hood covering at least the face of a user and having an air passage hole; a face piece attached to the inside of the hood so as to engage the nose and mouth of the user and having a tubular coupling end; a canister containing air-purifying antidote therein and having two opposed ends, with an intake hole being disposed at one end and a discharge hole being disposed at the other end; an inlet check valve; and an outlet check valve; characterized in that the mask further comprises: a substantially cylindrical sealing member made of soft non-flammable flexible material and having one end thereof airtightly secured to the periphery of the air passage hole of said hood; a canister-holder having a tubular coupling end thereof airtightly coupled with said tubular coupling end of the face piece, with said sealing member being interposed between said tubular coupling end of said canister-holder and said tubular coupling end of said face piece so as to create an airtight seal between said hood, said face piece and said canister-holder; said canister/holder having an inside chamber defined therein which chamber communicates with said face piece through said coupling end thereof and has an inlet opening and an outlet opening; and a connecting means for airtightly connecting said canister to said canister-holder in a detachable manner with the discharge hole of the canister facing the inlet opening of the canister-holder, the connecting means including a loop groove formed around the inlet opening of the canister-holder, and a loop projection integrally formed at the other end of the canister so as to snugly fit in said loop groove; the inlet check valve being interposed between the intake hole of the canister and the inside chamber of the canister-holder for permitting air flow through the inlet opening of the inside chamber only in the direction from the canister toward the inside chamber; and the outlet check valve being mounted on said outlet opening of said canister-holder so as to allow air outflow through said outlet opening only away from the inside chamber and exclusively to the atmosphere.

9. An emergency mask as set forth in claim 8, wherein said connecting means further comprises a packing inserted between the canister-holder around said inlet opening and the other end of said canister.

10. An emergency mask comprising: a hood covering at least the face of a user and having an air passage hole; a face piece attached to the inside of the hood so as to engage the nose and mouth of the user and having a tubular coupling end; a canister containing air-purifying antidote therein and having two opposed end, with an intake hole being disposed at one end and a discharge hole being disposed at the other end; an inlet check valve; and an outlet check valve; characterized in that the mask further comprises: a substantially cylindrical sealing member made of soft non-flammable flexible material and having one end thereof airtightly secured to the periphery of the air passage hole of said hood; a canister/holder having a tubular coupling end thereof airtightly coupled with said tubular coupling end of the face piece, with said sealing member being interposed between said tubular coupling end of said canister-holder and said tubular coupling end of said face piece so as to create an airtight seal between said hood, said face piece and said canister-holder; said canister-holder having an inside chamber defined therein which chamber communicates with said face piece through said coupling end thereof and has an inlet opening and an outlet opening; and a connecting means for airtightly connecting said canister to said canister-holder in a detachable manner with the discharge hole of the canister facing the inlet opening of the canister-holder; the inlet check valve being interposed between the intake hole of the canister and the inside chamber of the canister-holder for permitting air flow through the inlet opening of the inside chamber only in the direction from the canister toward the inside chamber; the outlet check valve being mounted on said outlet opening of said canister-holder so as to allow air outflow through said outlet opening only away from the inside chamber and exclusively to the atmosphere; and said canister being oriented so that when said mask is being worn said one end is at the bottom of said canister and said other end is at the top of said canister, and said canister having a rectangular cross-section at right angles to the direction between said ends thereof, said rectangular cross-section having a length (b), in the direction in which the user faces, which is longer than 1.15 time of a width (a) thereof, the width being at right angles to the length ($b > 1.15a$), the distance between said ends being not shorter than said width (a) thereof, said canister being held by said canister-holder with a spacing from said hood in a horizontally forward direction relative to said face piece when said mask is being worn, said forward spacing being larger than the lateral offset of said canister relative to said horizontally forward direction.

* * * * *

UNITED STATES PATENT AND TRADEMARK OFFICE

CERTIFICATE OF CORRECTION

PATENT NO. : 4,677,976

DATED : July 7, 1987

INVENTOR(S) : Katsumi FUJINUMA et al

It is certified that error appears in the above-identified patent and that said Letters Patent is hereby corrected as shown below:

In the heading of the patent, under [30], insert the following additional priority document:
--March 17, 1984 [JP] Japan .... 59-50170--.

Signed and Sealed this

Seventeenth Day of November, 1987

*Attest:*

DONALD J. QUIGG

*Attesting Officer*

*Commissioner of Patents and Trademarks*